United States Patent [19]

Halliday

[11] Patent Number: 4,976,353

[45] Date of Patent: Dec. 11, 1990

[54] PALLET BOX CONTAINER

[75] Inventor: George M. Halliday, Edinburgh, United Kingdom

[73] Assignee: A&W Fullarton Limited, Glasgow, Scotland

[21] Appl. No.: 225,271

[22] Filed: Jul. 28, 1988

[30] Foreign Application Priority Data

Aug. 5, 1987 [GB] United Kingdom ..... 8718499

[51] Int. Cl.[5] ..... B65D 19/06

[52] U.S. Cl. ..... 206/386; 108/56.3; 206/600; 229/125.28; 229/125.29

[58] Field of Search ..... 206/386, 599, 600, 596, 206/597; 108/56.1, 56.3; 217/43 A; 229/125.28, 125.29

[56] References Cited

U.S. PATENT DOCUMENTS

| | | | |
|---|---|---|---|
| 2,706,595 | 4/1955 | Fallert | 229/125.29 |
| 3,453,973 | 7/1969 | Vose, III et al. | 108/56.1 X |
| 3,519,190 | 7/1970 | Achermann et al. | 206/599 |
| 3,608,813 | 9/1971 | Blasdell | 206/599 |
| 3,809,305 | 5/1974 | Persson | 229/125.28 |
| 3,831,744 | 8/1974 | Walden et al. | 206/600 |
| 4,089,417 | 5/1978 | Osborne | 206/600 |
| 4,763,787 | 8/1988 | Koenig | 206/600 X |

FOREIGN PATENT DOCUMENTS

| | | | |
|---|---|---|---|
| 2314868 | 1/1977 | France . | |
| 2548139 | 1/1985 | France | 206/386 |
| 2592633 | 7/1987 | France | 206/386 |
| 2606371 | 5/1988 | France . | |
| 7714491 | 7/1979 | Sweden | 206/600 |
| 2007194 | 5/1979 | United Kingdom | 206/599 |
| 2114541 | 8/1983 | United Kingdom | 206/386 |
| 2138391 | 10/1984 | United Kingdom | 206/386 |
| 2193191 | 2/1988 | United Kingdom | 206/386 |

*Primary Examiner*—Bryon P. Gehman

*Attorney, Agent, or Firm*—Stephen G. Rudisill

[57] ABSTRACT

The invention discloses the provision of a container securable to a pallet to prevent the container or other goods to be carried from becoming dislodged from the pallet in transit. The invention provides a container having a base and side walls a plurality of the base having a plurality of articulatable lugs in the form of elongate tabs depending therefrom and each foldable to engage with a slot provided on the base so as to form a retaining loop which secures a portion of the pallet member between the tabs and the base of the container. The container may be erected from a blank, also described.

2 Claims, 2 Drawing Sheets

PALLET BOX CONTAINER

BACKGROUND OF THE INVENTION

The present invention relates to containers and in particular to box containers suitable for use in holding goods on pallets.

The use of pallets for the transportation of goods is very widespread. In general the goods are placed in suitable containers which are then stacked on top of the pallet. There is however often a danger, especially in transit, of the containers falling off the pallet resulting in possible damage to the goods and loss of time and effort in reloading the pallets. In order to avoid such problems, the stacked containers are often secured to the pallet with steel bands or other fixing means. These are however inconvenient to apply and remove and require special equipment and additional costs.

BRIEF DESCRIPTION OF INVENTION

It is an object of the present invention to avoid or minimize one or more of the above disadvantages.

The present invention provides a pallet box container for holding goods on a pallet and having side wall means and a base means, which base means is provided with a plurality of articulatable lug means depending therefrom and formed and arranged for folding around a plurality of pallet member portions for interengagement therewith so as to secure said container to said pallet in use of the container.

In a further of its several aspects, the present invention provides a pallet box container of the invention secured to a pallet with said articulatable lug means of said container folded around said pallet member portions of said pallet.

Thus with a pallet box container of the invention, the container and pallet are securely held together forming an integral unit whereby packing and unpacking of the goods is substantially simplified and accelerated whilst also increasing the security of the goods.

Conveniently the lug means are in the form of elongate tab members. The base means is generally in the form of a plurality of base flap means hingedly connected to the side wall means and securable to each other in overlapping relationship so as to form said base means. In this case the lug means are advantageously in the form of elongate tab means cut into respective base flap means. Advantageously the tab means are formed and arranged so as to have lateral projection means at opposed side of the tab means towards their distal ends so that said distal ends may be threaded into respective slots formed in the base flap means by cutting of said tab means thereinto and then captively retained therein by said projections thereby to secure a respective pallet portion between the tab means and the base flap means.

In another of its several aspects, the present invention further provides a pallet box container blank comprising a plurality of hingedly interconnected side wall panels with a securing means and plurality of bottom flaps hingedly connected to respective side wall panels, with first bottom flaps having cut thereinto elongate articulatable tabs, and second bottom flaps having formed therein narrow slots so that in an erected condition of said blank, the distal ends of said elongate tabs can be threaded through said narrow slots for securing of pallet member portions between said tabs and the base of the erected blank.

In yet another of its several aspects, the present invention still further provides a pallet wherein the uppermost side of said pallet is provided with transverse pallet members extending transversely of spaced apart pallet support members so as to define slots below said transverse members through which can be threaded, in use of the pallet, an elongate articulatable lug means of a pallet box container of the invention.

BRIEF DESCRIPTION OF DRAWINGS

Further preferred features and advantages of the present invention will appear from the following detailed description, given by way of example only, of a preferred embodiment illustrated with reference to the accompanying drawings in which.

DETAILED DESCRIPTION OF DRAWINGS

Figure 1:
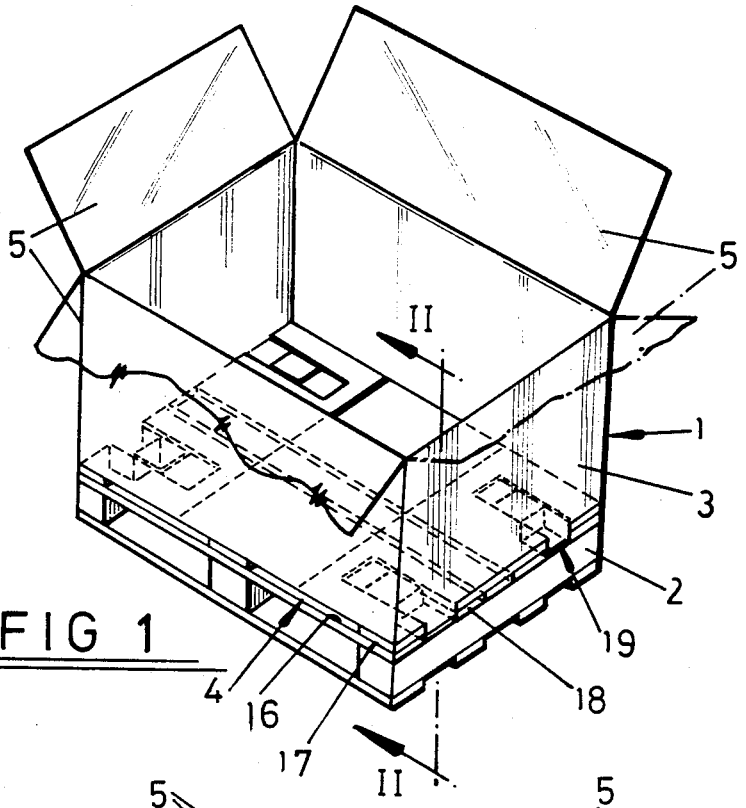
FIG. 1 is a general perspective view of a pallet box container of the invention mounted on a pallet.

FIG. 1 shows a pallet box container 1 mounted on a pallet 2 and having a plurality of side walls 3, a base 4 and a top closure made up of a plurality of overlapping top panels 5. As may be seen more clearly from FIGS. 3 and 4 the base 4 is made up of a plurality of base flaps 6. The base flaps 6 comprises a pair of opposed first base flaps 7 which have elongate tabs 8 cut into them and second opposed base flaps 9 provided with narrow slots 10 towards each side 11 of each said second base flap 9. The tabs 8 are cut into the first base flaps 7 so that they are hingedly connected 12 to the adjoining side wall 13 to which said first base flap 7 is hingedly connected. Towards their distal ends 14 the tabs 8 are provided with small laterally extending projections 15. The narrow slots 10 have a length generally equal to or slightly greater than the width of the tabs 8 so that the tabs 8 with their projections 15 are a push-fit through said slots 10.

Figure 2:
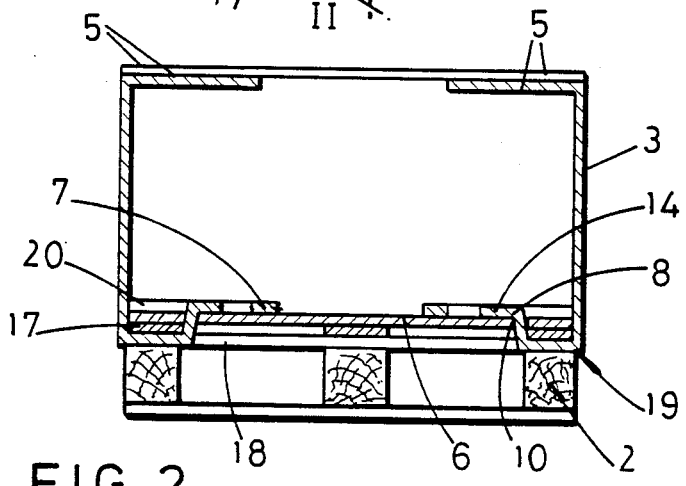
FIG. 2 is a longitudinal section taken on line II—II of FIG. 1.

The pallets 2 of the invention as illustrated in the various drawings are provided at their uppermost side 16 with relatively thin crossmembers 17 extending transversely of the normal upperside pallet support strips 18 so as to define together therewith narrow slots 19 beneath said crossmembers 17 through which can be threaded the tabs 8. As may be seen more clearly in FIG. 2, the distal ends 14 of the tabs 8 are threaded through the slots 19 and then up around the crossmembers 17 through the narrow slots 10 in the second base flaps 9 and then folded back down to lie within the side slots 20 left in the first base flaps 7 by the tabs 8 cut thereof and to form a retaining loop. In this way, the pallet box container 1 is securely attached to the pallet 2 in a particularly simple and economic manner.

Figure 3:
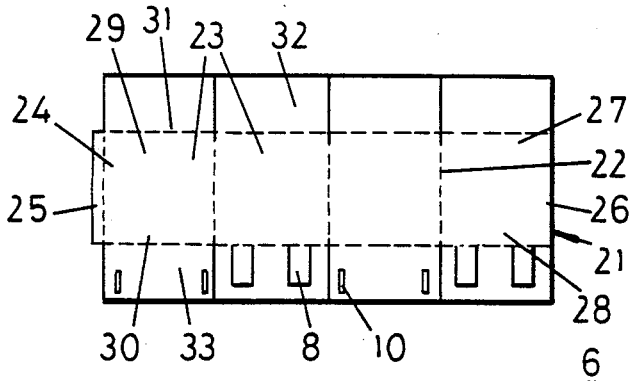
FIG. 3 is a plan view of a pallet box container blank of the invention.
Figure 4:
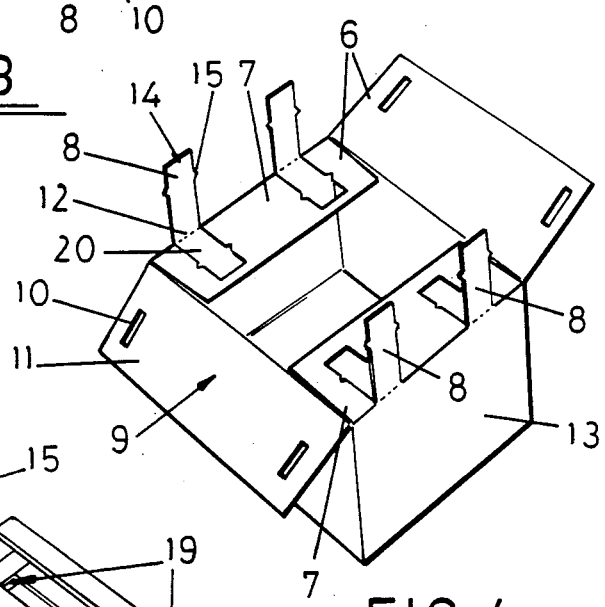
FIG. 4 is a bottom perspective view of a pallet box container of the invention in a partially assembled condition.
Figure 5:
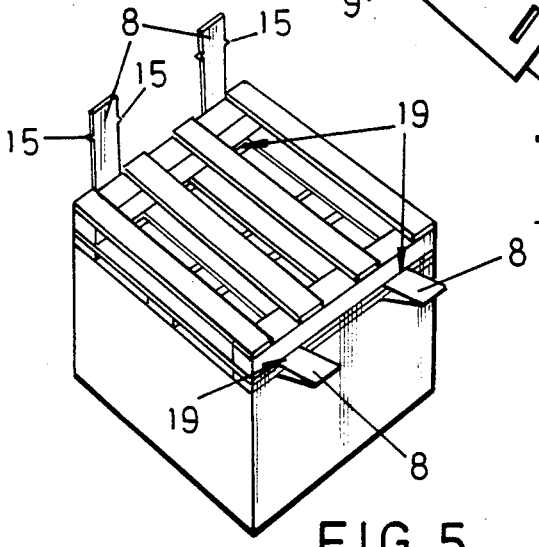
FIG. 5 is a similar view to that of FIG. 4 showing the pallet box container in the process of being secured to a pallet.

FIG. 3 is a plan view of a generally rectangular blank 21 of a box container of the invention, and comprises a row of four rectangular hingedly interconnected 22 side wall panels 23 provided by one end 24 by an elongate securing tab 25 for attachment to the free edge 26 of the side wall panel 27 at the other end 28 of said row in the erected condition of the box container. Each of said side wall panels 23 has hingedly attached 31 thereto at opposite sides 29, 30 thereof, a top flap 32 and a base flap 33 in which are cut the elongate tabs 8 and the narrow slots 10.

The box container of the invention may be made of any suitable material but conveniently is made of a natural or synthetic board, cardboard, fibre board, corrugated board or other like material used in the manufacture of folded panel box containers.

It will be appreciated that various modifications may be made to the above described embodiments without departing from the scope of the present invention. Thus, for example, different forms of pallet allowing, for example, two-way or four-way entry of a fork lift truck thereinto and different forms and/or numbers of securing tabs 8 could be used.

I claim:

1. An arrangement comprising:

a pallet box container removeably fastened to a pallet for holding goods on the said pallet and having four side walls and a base including a pair of first base flaps and a pair of second base flaps, said base is provided with a plurality of articulatable lugs depending therefrom and folded around a plurality of pallet member portions without contact with an external structure which supports the bottom of the pallet and turned in through slots formed in said second pair of base flaps so the distal ends of the said articulatable lugs are inside the said pallet box container so as to secure said pallet box, container to said pallet in use of the said pallet box container, the said articulatable lugs being cut from and leaving voids in the said first pair of base flaps which close the bottom of the said pallet box container, whereby the said second pair of base flaps cover the voids left by the articulatable lugs, said second pair of base flaps containing slots formed therein, the said slots being accessible only from the bottom of the pallet, and said articulatable lugs being inserted to close the slots against access.

2. A pallet box container blank, said blank comprising:

four hingedly interconnected and sequential side wall panels and four base flaps hingedly connected in sequence to respective side wall panels, wherein each said base flap has formed therein either slots or articulatable lugs, wherein sequentially first and third base flaps are cut to form elongate articulatable lugs, said articulatable lugs extending from the hinged ends of the first and third base flaps toward the free ends of said first and third base flaps, and wherein sequentially second and fourth base flaps have formed therein narrow slots, said slots being cut of a width approximately equal to the width of the said articulatable lugs, and wherein said slots formed in said second and fourth base flaps are positioned such that the distance from the center of each slot to the hinged end of the respective second and fourth base flaps is equal to the distance from the center of the adjacent articulatable lug to the nearer adjacent side of the respective first and third base flaps, and wherein the said slots formed in said second and fourth base flaps are positioned such that the distance from the each slot to the nearer adjacent side of the respective second and fourth base flaps is less than the length of the articulatable lugs.

* * * * *